US005522316A

United States Patent [19]

Singler

[11] Patent Number: 5,522,316

[45] Date of Patent: Jun. 4, 1996

[54] JOURNAL MOUNTED CYLINDERS WITH SWINGABLE ACCESS DOORS

[75] Inventor: Josef Singler, Höchstädt, Germany

[73] Assignee: MAN Roland Druckmaschinen AG, Offenbach am Main, Germany

[21] Appl. No.: 427,412

[22] Filed: Apr. 24, 1995

[30] Foreign Application Priority Data

Apr. 22, 1994 [DE] Germany ..... 44 14 084.3

[51] Int. Cl.[6] ..... B41F 1/34

[52] U.S. Cl. ..... 101/479; 101/216

[58] Field of Search ..... 101/216, 212, 101/219, 375, 376, 477, 479, 193, 192, 141, 142

[56] References Cited

U.S. PATENT DOCUMENTS

| | | | |
|---|---|---|---|
| 3,326,439 | 6/1967 | Sarka | 101/216 |
| 3,986,454 | 10/1976 | Granger | 101/216 |
| 4,913,048 | 4/1990 | Tittgemeyer | 101/141 |
| 5,060,569 | 10/1991 | Gladow | 101/216 |
| 5,101,726 | 4/1992 | Lübke et al. | 101/216 |
| 5,161,464 | 11/1992 | Albrecht | 101/219 |
| 5,237,920 | 8/1993 | Guaraldi | 101/216 |
| 5,241,903 | 9/1993 | Lampie | 101/216 |
| 5,241,905 | 9/1993 | Guaraldi et al. | 101/216 |
| 5,398,604 | 3/1995 | Burke et al. | 101/479 |
| 5,458,061 | 10/1995 | Koura et al. | 101/216 |

FOREIGN PATENT DOCUMENTS

| | | |
|---|---|---|
| 0352599 | 1/1990 | European Pat. Off. . |
| 490994 | 2/1930 | Germany . |

*Primary Examiner*—Eugene H. Eickholt

*Attorney, Agent, or Firm*—Cohen, Pontani, Lieberman, Pavane

[57] ABSTRACT

A rotary printing machine having a side wall with an opening therein through which at least one cylinder can be accessed. In order to uncover the wall opening in the side wall, a door is provided that can be operated in a structurally simple manner, so that, in particular, a sleeve-type printing form or a sleeve-type rubber blanket can be changed through this opening. The door is divided in the area of the journals of the printing group cylinders into two door members, which are arranged on the side wall so as to be swingable away from the journals.

14 Claims, 4 Drawing Sheets

JOURNAL MOUNTED CYLINDERS WITH SWINGABLE ACCESS DOORS

BACKGROUND OF THE INVENTION

1. Field of the Invention

The invention relates to a rotary printing machine having multiple coupled cylinders which are mounted indirectly in side walls of the printing machine by journals.

2. Description of the Related Art

A printing unit in which two printing groups are arranged one above the other and work together on the basis of the blanket-to-blanket principle is disclosed in U.S. Pat. No. 5,241,905. The cylinders of the printing units are mounted by journals in side walls of the printing machine. One of the side walls has an opening in the area of the transfer cylinders. This opening can be opened or closed by two doors arranged one above the other on the side wall in swingable fashion. In the opened position, sleeve-type rubber blankets can be removed from or slipped onto the transfer cylinders. In the closed position, each door accommodates the journal of a transfer cylinder. To this end, each journal is mounted in a bearing bush. The bearing bush is in turn accommodated by a bore in the door. The bearing bush is thereby clamped on a partial area of its mantle in two semicircular clamping jaws, one of which jaws is detachable. To allow the door to swing into the opened position and thus to uncover the opening and the cylinder journal, the one clamping jaw must first be detached. To do this, a working cylinder and a multi-element gear are needed, which makes the device expensive. Furthermore, the pivoted bearing of the door itself is expensive. European Reference 0 352 599 B1 discloses a printing unit in which the opening in a side wall is surrounded by two bearing shields. In this arrangement, the journals of the cylinders are mounted in the separating plane of the bearing shields. To uncover the opening, the bearing shields are moved apart laterally. To allow the entire transfer cylinder area and plate cylinder area to be opened by means of a pair of bearing shields, the height-width relationship of the bearing shields becomes very large, which results in the danger of tilting. Appropriate precautions must be taken or several pairs of bearing shields must be used. In addition, the forces required for the adjustment movement and the fixing in place are very high.

SUMMARY OF THE INVENTION

Accordingly, it is an object of the present invention to provide a rotary priming machine having a door that can be operated with structurally simple means to uncover the wall opening.

Pursuant to this object, and others which will become apparent hereafter, one aspect of the present invention resides in a rotary printing machine having a door which covers the opening and side wall of the printing machine, which door is divided into two door members in the area of the journal of the cylinder adjacent to the opening. The door members are pivotably mounted to the side wall of the printing machine so as to be swingable away from the journal about swing axes.

The door members can be opened without the first uncovering the bearing bushes of the cylinders. Expensive devices for this are therefore unnecessary. Furthermore, the swinging movements can be realized in a structurally simple manner, and problems of eliminating play do not arise. In addition, the closed position can be fixed in place in a simple manner. The movement forces for the door members are low and thus can be supplied by pneumatic drives. Also, one pair of door members can uncover multiple cylinder journals. All of these advantages contribute to significant savings in costs.

The door members can be arranged either side by side or one above the other so that their swing axes are either vertical or horizontal, respectively.

In another embodiment of the invention, bolts are attached to the door members concentric to the swing axes and the bolts, which extend from common ends of the door members, extend into respective console members so that the door, together with the console members can be set into the opening in the side wall. Springs are arranged in one of the consoles so as to push against the bolts and force the door members against the other of the consoles.

In still a further embodiment of the invention, the door members respectively form the drive rocker of a four-bar mechanism. An additional drive rocker is mounted to the side wall and is connected to the door member in a hinged fashion by a coupling rod. A motor can be used to drive the second drive rocker.

In yet another embodiment of the invention, the bore of the bearing bush which holds the journal of the cylinder at the door, is eccentric to the outer mantel of the bearing bush. A bearing bush further has a toothed segment that is concentric to the outer mantel. A spur gear pivotably mounted to the door member can be swung by a working cylinder, also connected to the door member, so that the spur gear engages the toothed segment of the bearing bush when the door member is in the closed position.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
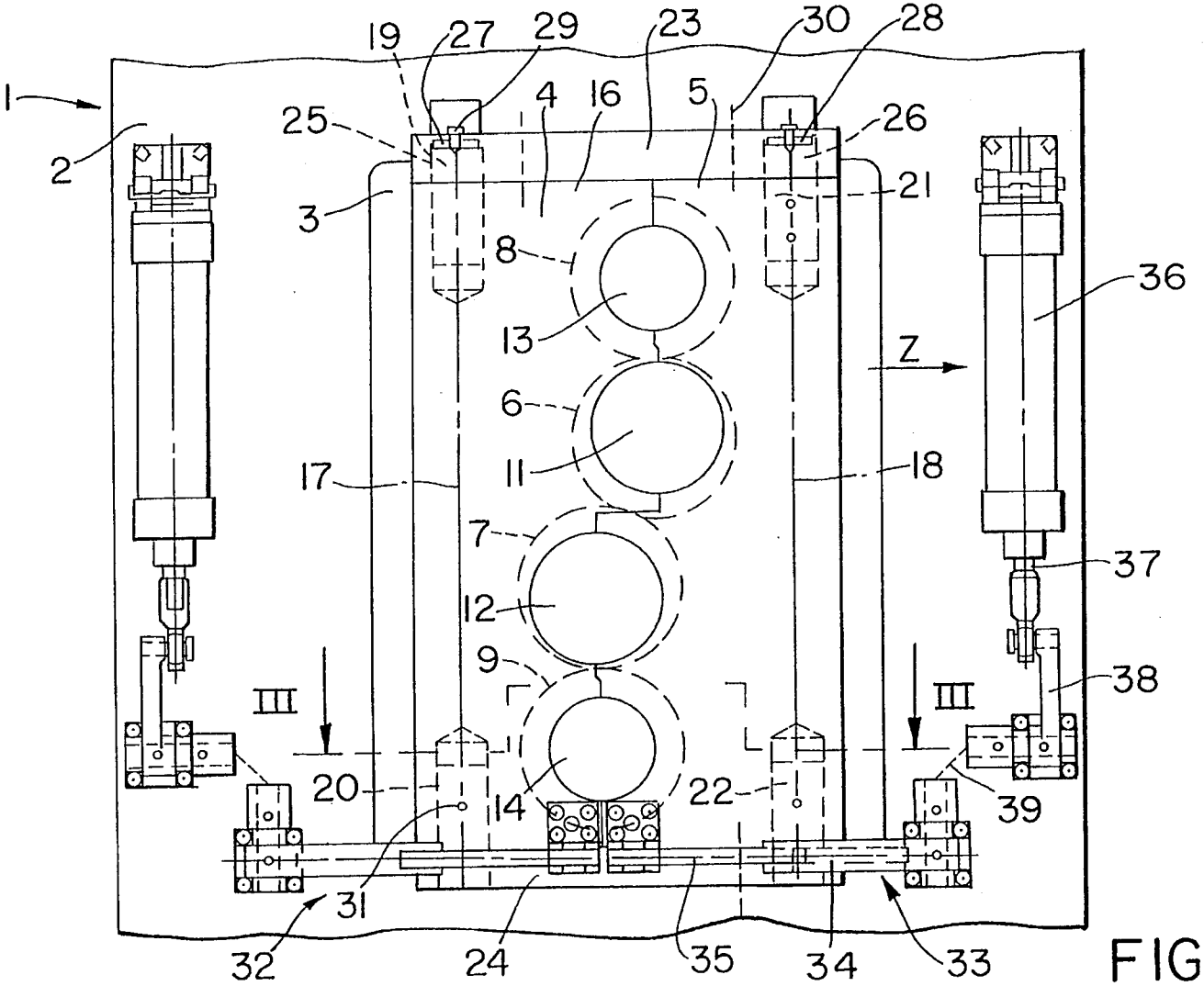
FIG. 1 is a partial view of a side wall of a printing machine pursuant to the present invention.
Figure 3:
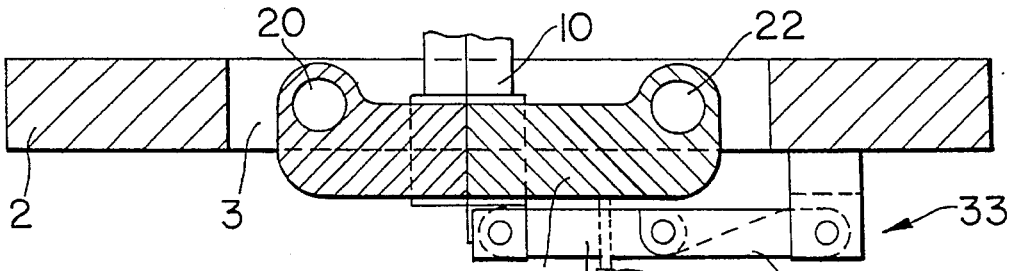
FIG. 3 is a sectional view along the line III—III in FIG. 1, not showing the drive of door wing 4.

FIG. 1 shows a partial view of a printing machine unit machine having side walls. One of the side walls 2, in particular, the side wall from which the machine is operated has an opening 3 which is closed by two door members 4, 5. FIGS. 1 and 3 show of the door members 4, 5 in a closed position. The printing unit contains four cylinders; specifically, two transfer cylinders 6, 7, which are adjustable relative to one another and each of which works together with one form cylinder 8, 9. The cylinders 6 to 9 have journals 10 directed toward the side wall 2 and mounted in bearing bushes 11 to 14, respectively, which in turn are mounted in the door members 4, 5 when the doors are in the closed position.

The door members 4, 5 represent, in practical terms, the parts created by the division of a door 16. The plane of division runs centrally to the outer mantle of the bearing bushes 11 to 14 and parallel to the swing axes 17, 18 of the door members 4, 5. When different distances exist between the bearing bushes 11 to 14 and the swing axes 17, 18, multiple planes of division are created, and an interconnecting division is advantageously produced by division planes located vertical to the swing axes 17, 18. The position of the swing axes 17, 18 is chosen so that when the door members 4, 5 are in the closed state, the contours of the door members 4, 5 touching the bearing bushes 11 to 14 do not pass through the plane through the swing axes 17, 18 (FIG. 3). Otherwise, when the door members 4, 5 are opened, these door areas would push on the mantle of the bearing bushing, i.e., it would not be possible to open the door members.

Each door member 4, 5 has two bolts 19, 20 or 21, 22, which extend out of the door member 4, 5 concentric to axis 17, 18. The two adjacent bolts 19, 20 or 21, 22, respectively, of the door members 4, 5 are inserted into the bores of a console 23, 24 and are secured by pins 31. Together with these consoles 23, 24, the door members 4, 5 are set into the opening 3 in the side wall 2. The bores 25, 26 of the console 23 are not through-bores. At the bottom, the bores contain leaf or plate springs 27, 28, which press the console 23 against the edge of the opening 3 and press the door members 4, 5, along with the console 24, against the opposite edge of the opening 3 in the side wall, thus clamping the door members 4, 5 relative to the side wall 2 in a play-free manner. In order to set the door members 4, 5 into the side wall, screws 29 are first inserted through passage holes in the console 23, then screwed into the bolts 19, 21 and tightened. As the plate springs 27, 28 are deflected in, the console 23 is drawn toward the door members 4, 5. In this way, the outer dimension of the door members 4, 5 preassembled with the consoles 23, 24 is smaller than the clear space of the associated edges of the opening 3 in the side wall 2, and the preassembled door members 4, 5 and consoles can be inserted into the opening. When the screws 29 are now loosened, the console 23 is pressed against the edge of the opening 3 and the door members 4, 5 are braced along the consoles 23, 24 in the side wall 2. Advantageously, the consoles 23, 24 are also screwed to the side wall 2 by screws 30. Instead of plate springs, it is also possible to use, for example, helical springs. Even these springs can be dispensed with; however, when no springs are used it is very costly to fit the door members 4, 5 into the side wall 2. In addition, the door members 4, 5 can be mounted in the side wall 2 in a different manner, for example, in a hinged manner, as described below.

Figure 2:
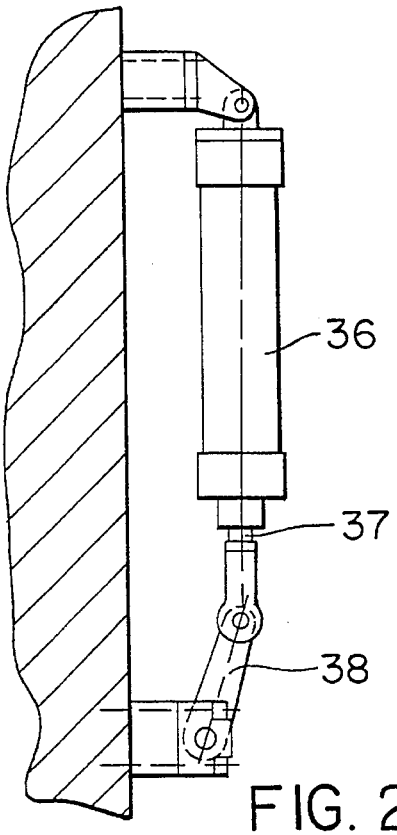
FIG. 2 is a view along arrow Z in FIG. 1.
Figure 4:
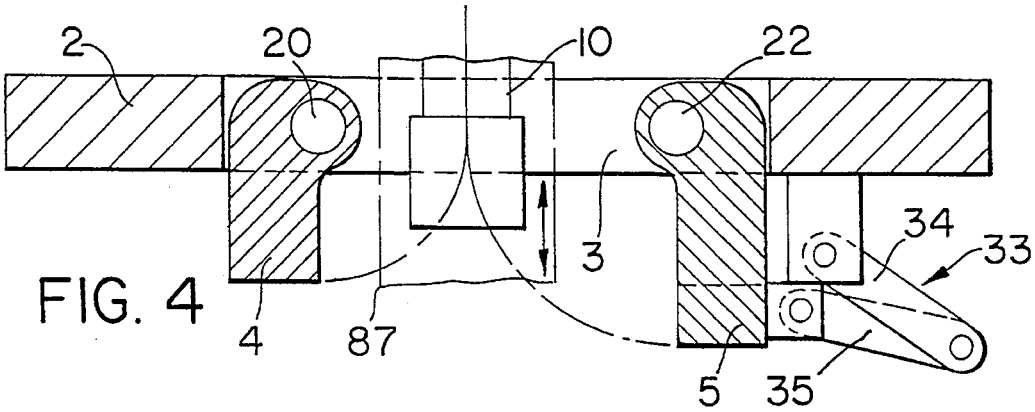
FIG. 4 is a view similar to FIG. 3 with the door wings in an open position.

To swing the door members from the closed position shown in FIG. 3 into the opened position shown in FIG. 4 and vice versa, whereby the door members 4, 5 are swung, respectively, by approximately 90°, a drive 32, 33 acts upon each door member 4, 5. The drive 33 contains a four-bar mechanism, whereby the door member 5 functions as a drive rocker. The drive rocker 34 of the four-bar mechanism is mounted on the side wall 2 and is connected in a hinged manner to the door member 5 via a coupling bar 35. Furthermore, the drive rocker 34 is in drive connection with a drive mechanism or motor. In the illustrated example, a working cylinder 36 mounted on the side wall 2 in a hinged manner is used (FIG. 2) for this purpose. The piston rod 37 of the working cylinder 36 is linked to a lever 38, which is mounted pivotally in the side wall 2 and connected by means of a cardan shaft 39 to the drive rocker 34. When the door member 5 is in the closed position (FIG. 3), the four-bar mechanism assumes an over-dead-center position, i.e., the drive rocker 34 is rotated out slightly in the clockwise direction across the extended position with the coupling bar 35. This over-dead-center position is set by a stop screw 40 lying on the door member 5 and screwed into the coupling bar 35. The over-dead-center position reliably locks the door member 5 against unintentional opening, even in the case of pressure interruption in the working medium of the working cylinder 36. A drive of the same type is provided for the door member 4 and is therefore not described further. The drive 32 for the door member 4 is not shown in FIGS. 3 and 4 for reasons of simplification.

The opening 3 is uncovered when the door members 4, 5 are swung into the position shown in FIG. 4. To do this, the working cylinders of the drives 32, 33 of the door members 4, 5 are reversed. For the door member 5, this is the working cylinder 36. Upon its extension, the lever 38 is swung downward which causes the lever 38 to drive the drive rocker 34 via the cardan shaft 39. When the drive rocker 34 is swung counter-clockwise, it pulls the door member 5 into the opened position via the coupling bar 35. The door member 4 is moved in an analogous fashion. The cylinders 6 to 9, which are now uncovered at their journals pointing to the side wall 2, are held poised by their journals mounted in the other side wall by clamping means that are known and do not form part of the present invention, and thus are not shown or described. It is now possible for printing forms and transfer forms, regardless of whether they are continuous, i.e., sleeve-type, or finite, to be withdrawn from the transfer and form cylinders 6 to 9 and removed from the printing unit through the opening 3, or, conversely, introduced into the printing unit through this opening. A sleeve-type printing form 87 which is passed straight through the opening 3 is shown in FIG. 4 with dot-dashed lines.

The four-bar mechanism used in driving the door members 4, 5 has the advantage that its drive rocker, embodied by the door members, can be designed to be large, i.e., with a long lever arm. As a result, the drive forces are low, which means that pneumatic cylinders can be used. However, it is also possible to use other drive motors to drive the four-bar mechanism. For example, the drive rocker can be connected to a worm gear, which is driven by a motor with a reversible rotational direction.

Figure 5:
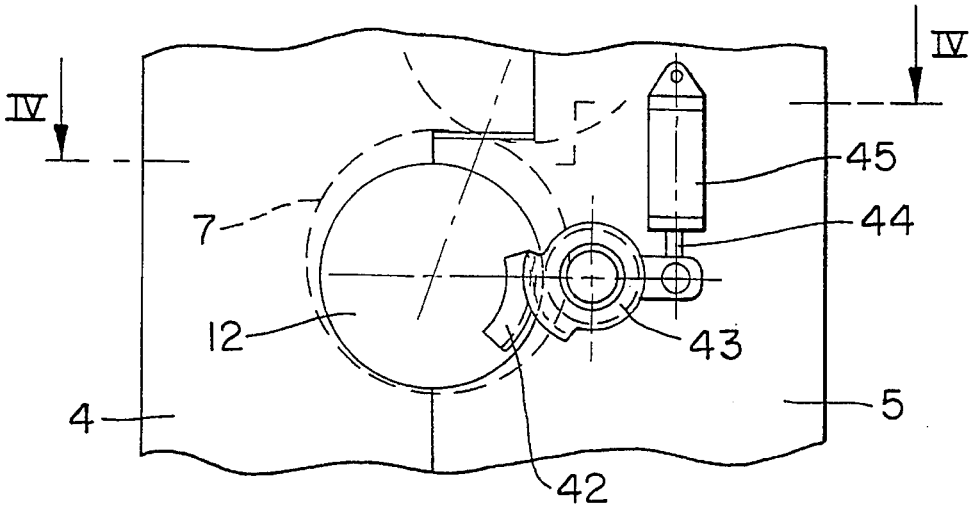
FIG. 5 shows the drive of the bearing bushes of transfer cylinder 7.
Figure 6:
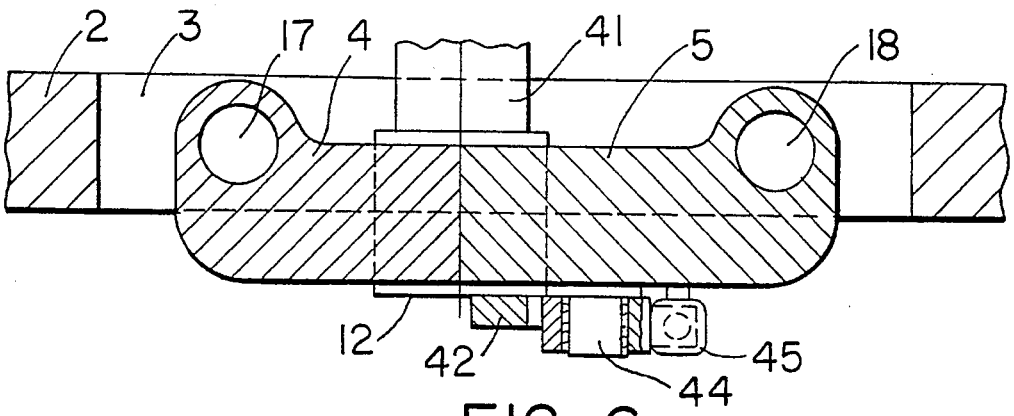
FIG. 6 is a sectional view along the line VI—VI in FIG. 5, partially sectioned.
Figure 7:
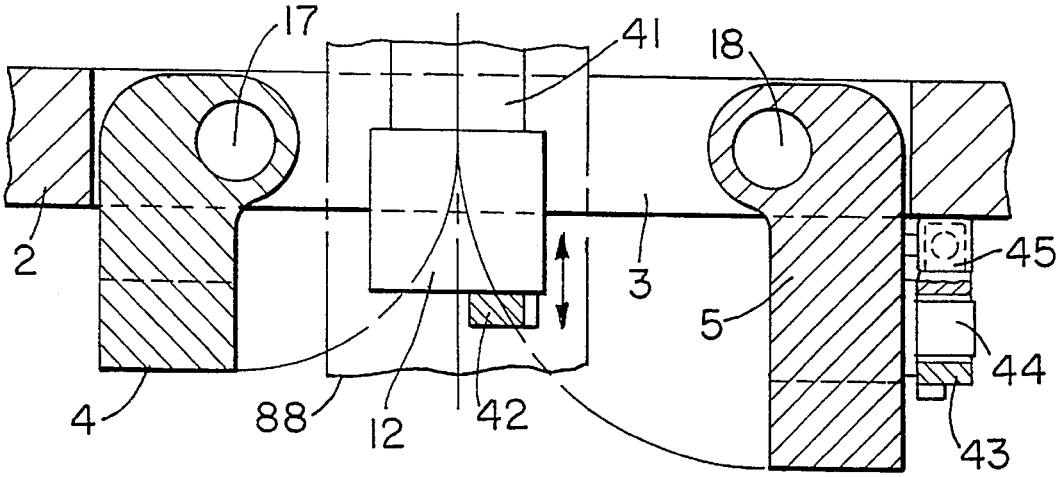
FIG. 7 is a view similar to FIG. 6 in an open position.

The drive of the eccentric bearing bushes, e.g., the bearing bushes 11, 12, for placing and removing the transfer cylinders 6, 7 into and out of the printing position, can also be advantageously realized in the framework of the present invention. An actuating gear for such a bearing bush is shown in FIGS. 5 to 7, which, upon the opening and closing of the door member, automatically disconnects and connects itself with the bearing bush. In FIG. 5, the bearing bush 12 mounted in the door members 4, 5 of the transfer cylinder 7 is shown. The journal 41 of this cylinder 12 is mounted in a bore located eccentric to the outer mantle of the bearing bush 12. Concentric to its outer mantle, the bearing bush 12 carries a toothed segment 42 of the straight-toothed type, into which a spur gear 43 engages when the door member 5 is in the closed position (FIG. 6). This spur gear 43 is designed as a segmental wheel and is mounted on a bearing bolt 44 attached to the door member 5. Furthermore, the spur gear 43 is connected in a hinged fashion to a working cylinder 45, which is connected pivotally to the door member 5.

Depending on the direction of actuation of the working cylinder 45, the spur gear 43 is swung in one direction or the other, which in turn rotates the bearing bush 12 in one direction or the other for print setting or non-print-setting. When the door member 5 swings into the opened position (FIG. 7), the teeth of the co-travelling spur gear 43 can emerge unobstructed from the toothing of the toothed segment 42. Conversely, when the door member 5 swings into the closed position, the teeth of the spur gear 43 enter into the tooth spaces of the toothed segment 42, and in this way the drive connection of this spur gear drive is reestablished. FIG. 7 shows, in schematic fashion, a sleeve-type rubber blanket 88 passing through the opening 3 in the side wall 2. For the sake of clarity, an actuation gear of the same type as shown in FIG. 5 is provided for the bearing bush 6.

Figure 8:
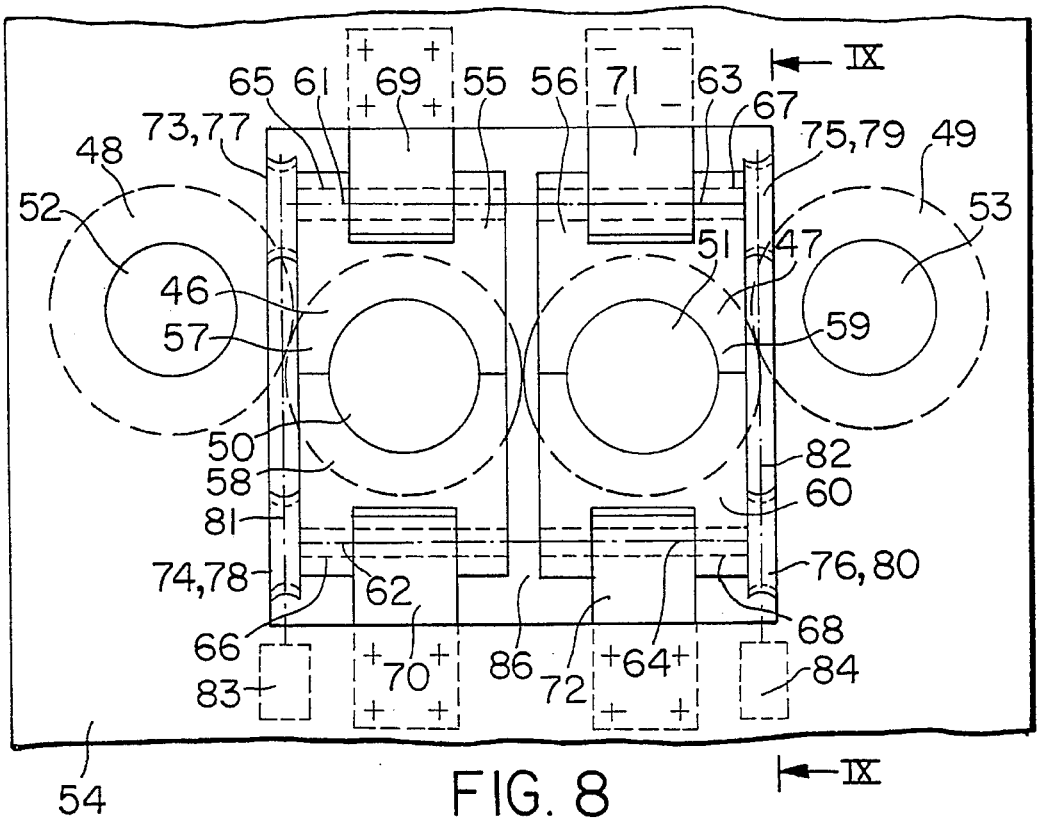
FIG. 8 illustrates a further embodiment of the invention.
Figure 9:
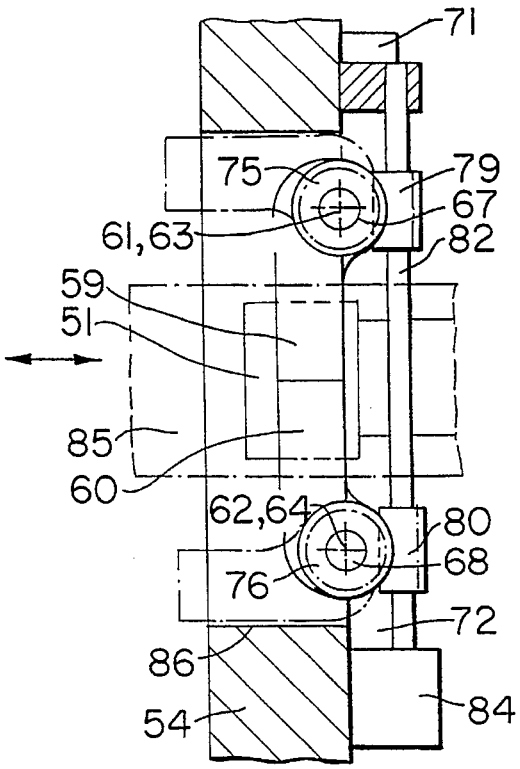
FIG. 9 is a sectional view along the line IX—IX in FIG. 8.

The door members of the door can also be arranged on more or less horizontal swing axes, depending on the position of the printing group cylinders and the available space conditions. In addition, cylinders can be accommodated in a door in a number other than four as contained in the described embodiment. For instance, FIG. 8 shows a sectional view of a printing unit with two transfer cylinders 46, 47 and two form cylinders 48, 49, all of which are arranged roughly horizontally. The journals of these cylinders 46 to 49 are accommodated in the bearing bushes 50 to 53. The bearing bushes 52, 53 of the form cylinders 48, 49 are mounted directly in the side wall 54, while the bearing bushings 50, 51 of the transfer cylinders 46, 47 are accommodated in the doors 55, 56. Each of the doors 55, 56 is divided, centrally to the outer mantle of the bearing bushes 50, 51 mounted therein, into two door members 57, 58, and 59, 60, respectively. The division runs parallel to the horizontally-arranged swing axes 61 to 64 of the door members 57 and 60. Into each door member 57 to 60, one axis 65 to 68 is inserted, by means of which the respective door members 57 to 60 are mounted in bearing blocks 69 to 72, which are screwed to the side wall. In keeping with the criteria mentioned above, the position of the swing axes 61 to 64 is again chosen so that the door members 57 to 60, when swung out, move away across their entire cross-sectional area from the bearing bushes 50, 51 (FIG. 9). The axes 65 to 68 are non-rotatably connected to the respective door members 57 to 60, and each of them carries, also in noir-rotatable fashion, a worm wheel 73 to 76. A worm 77 to 80 is engaged with each worm wheel 73 to 76. The two worms 77, 78 or 79, 80 of a door are respectively attached to a worm shaft 81, 82 in a rotation-proof fashion. Each worm shaft 81, 82 is driven by a motor 83, 84 having a reversible rotational direction. The two worms 77, 78 or 79, 80 of the respective worm shafts 81, 82 have opposite thread directions.

To swing the door members 57 to 60 into the open position (shown in FIG. 9 by dot-dashed lines 9), the motors 83, 84 are switched on. This sets into rotation the worms 77 to 80, which drive the worm wheels 73, 74 or 75, 76 of a door 55, 56 in opposite rotational directions and cause the door members 57 to 60 to swing out. It is now possible, for example, to remove the rubber blanket 85 (shown in FIG. 9 in dotted lines) from the transfer cylinder 47 and to pass it out through the opening 86 in the side wall 54 from the printing unit, or conversely, to slip it onto the transfer cylinder 47. The doors 55, 56 can be opened individually, independent of one another, as required. To close the opening 86, i.e., to swing the door members 57 to 60 back, the motors 83, 84 are run in a reverse rotational direction. The use of self-locking worm/worm wheel gears to drive the door members 57 to 60 ensures their secure positioning in the opened and closed positions. The bearing of the door members 57 to 60 in the side wall 54, as well as their drive, can also be carried out differently, for example, as shown in FIG. 1. The drive for turning the bearing bushes 50 and 51 can be designed analogously to those shown in FIGS. 5 to 7 and is therefore not depicted or described.

Advantageously, the door members of the door can be adjusted relative to one another in the closed position, in order to eliminate undesired play between the door and the bearing bushes. To this end, one of the door members can be eccentrically mounted, for example. For this purpose, the bearing journal of the door member can be accommodated in the door member or in the side wall in eccentric bushings, for example, or can itself be designed eccentrically. After assuming the closed position, the eccentric bushings or the eccentric bearing journal are activated for the purpose of locking.

The invention is not limited by the embodiments described above which are presented as examples only but can be modified in various ways within the scope of protection defined by the appended patent claims.

I claim:

1. A rotary printing machine, comprising:

side walls;

multiple coupled cylinders having journals, the cylinders being mounted by their journals to the side walls, one of the side walls having an opening adjacent at least one of the cylinders whereby the at least one cylinder can be accessed; and door means mounted to the one wall so as to open and close the opening in the side wall, said door means including a door swingable into a closed position in which the opening in the side wall is closed, the door being adapted so that when in the closed position the journal of the at least one cylinder is mounted to the door, the door being formed of two door members separated in an area of the journal, the door members being mounted to the one side wall so as to be swingable away from the journal about swing axes.

2. A rotary printing machine as defined in claim 1, wherein the door members are arranged to be substantially adjacent to one another and so that the swing axes are substantially vertical.

3. A rotary printing machine as defined in claim 1, wherein the door members are arranged above one another so that their swing axes are substantially horizontal.

4. A rotary printing machine as defined in claim 1, wherein the door means further includes two console members, the console members being respectively arranged at opposite ends of the door members relative to the swing axes, and two bolts attached to each of the door members, one of the bolts being respectively attached to each end of the door members so as to be concentric to the swing axes and so that the bolts extending from common ends of the door members extend into one of the console members, the door members and the consoles being mounted in the opening in the side wall, and further comprising spring means for supporting the door members so that the door members are braced on one of the console members against the other of the console members in a forced manner.

5. A rotary printing machine as defined in claim 1, wherein the journals of several cylinders are mounted to the two door members of the door means.

6. A rotary printing machine as defined in claim 1, and further comprising a pair of four-bar mechanisms, each of the door members being arranged and adapted to form a first drive rocker of one of the four-bar mechanisms, each of the four-bar mechanisms having a second drive rocker mounted to the one side wall, and a coupling rod connected between the door member and the second drive rocker, and still further comprising means for driving the second drive rocker.

7. A rotary printing machine as defined in claim 6, wherein the drive means includes, for each door member, a lever pivotally mounted to the one side wall, and a working cylinder connected to the lever, the second drive rocker being driveably connected to the lever whereby the four-bar mechanism assumes an over-dead-center position when the door members are in the closed position.

8. A rotary printing machine as defined in claim 6, wherein the drive means includes a reversible motor and a worm gear driven by the motor, the drive rocker being in drive connection with the worm gear.

9. A rotary printing machine as defined in claim 1, and further comprising for each door member a reversible motor attached to the one side wall, and a pair of worm wheels, one of the worm wheels being respectively arranged at each end of the door member concentric to the swing axis of the door member, and a pair of worms arranged so as to respectively engage the worm wheel and be driven by the motor.

10. A rotary printing machine as defined in claim 1, and further comprising a bearing bush mounted to the door members, the journal of the at least one cylinder being supported in a bore of the bearing bush.

11. A rotary printing machine as defined in claim 10, wherein the bearing bush has an outer mantle, and the bore of the bearing bush that supports the journal of the at least one cylinder is eccentric to the outer mantle, the bearing bush further has a toothed segment arranged thereon concentric to the outer mantle, and further comprising a spur gear pivotally mounted on one of the door members, and a working cylinder arranged on the door member and connected to the spur gear whereby the spur gear engages the toothed segment of the bearing bush when the door member is in the closed position.

12. A rotary printing machine as defined in claim 1, wherein one of the door members is mounted so as to be adjustable to another of the door members.

13. A rotary printing machine as defined in claim 12, and further comprising means for adjusting the one door member relative to the other door member.

14. A rotary printing machine as defined in claim 6, wherein the driving means for the second drive rocker includes a motor.

* * * * *